US005782182A

United States Patent [19]

Ruckmann et al.

[11] Patent Number: 5,782,182

[45] Date of Patent: Jul. 21, 1998

[54] PRINTING GROUP FOR A COLOR-PRINTING WEB-FED ROTARY PRESS

[75] Inventors: Wolfgang Günter Ruckmann, Würzburg; Martin Heinz Schoeps, Güntersleben, both of Germany

[73] Assignee: Koenig & Bauer-Albert Aktiengesellschaft, Wurzburg, Germany

[21] Appl. No.: 702,554

[22] PCT Filed: Mar. 7, 1995

[86] PCT No.: PCT/DE95/00303

§ 371 Date: Sep. 10, 1996

§ 102(e) Date: Sep. 10, 1996

[87] PCT Pub. No.: WO95/24314

PCT Pub. Date: Sep. 14, 1995

[30] Foreign Application Priority Data

Mar. 10, 1994 [DE] Germany ..... 44 08 025.5

[51] Int. Cl.[6] ..... B41F 5/08; B41F 5/22

[52] U.S. Cl. ..... 101/177; 101/180

[58] Field of Search ..... 101/181, 177, 101/220, 219, 228, 180, 182–185, 136–140, 142–145

[56] References Cited

U.S. PATENT DOCUMENTS 5,209,159 5/1993 Asanuma .

FOREIGN PATENT DOCUMENTS 0 400 444 12/1990 European Pat. Off. .
42 19 705 12/1992 Germany .
44 21 437 10/1994 Germany .

*Primary Examiner*—J. Reed Fisher
*Attorney, Agent, or Firm*—Jones, Tuller & Cooper, P.C.

[57] ABSTRACT

A printing system for a multi-color web-fed rotary printing press utilizes a plurality of printing system units that are arranged in a vertical array. Each printing system unit includes a left printing unit and a right printing unit. The left or the right units are supported in a frame which is shiftable horizontally with the respect to the frame that supports the other units.

21 Claims, 7 Drawing Sheets

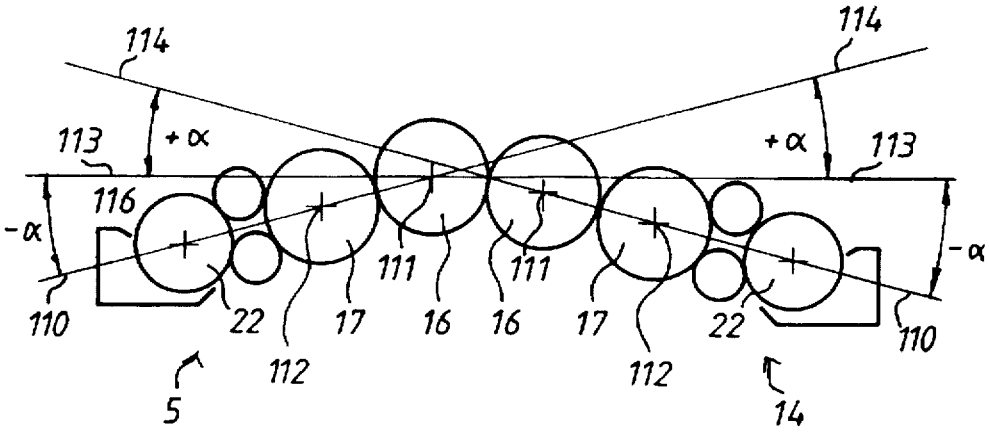
Fig. 10
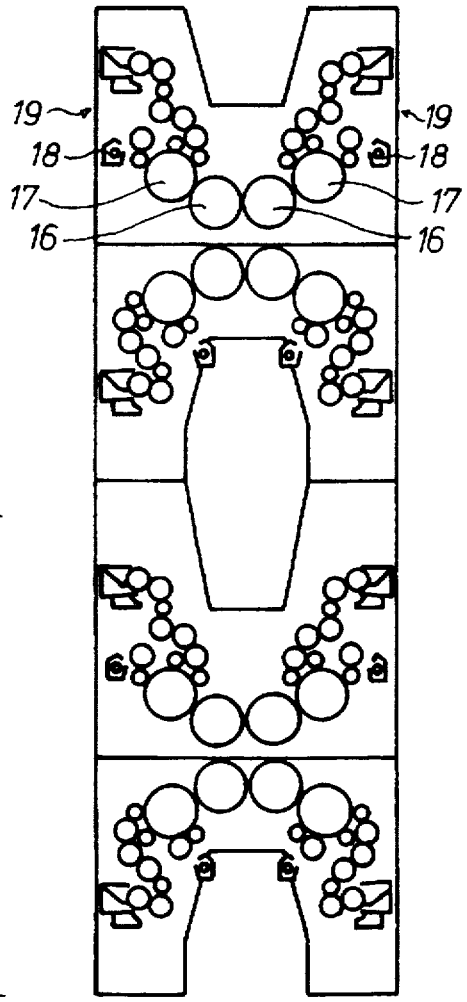
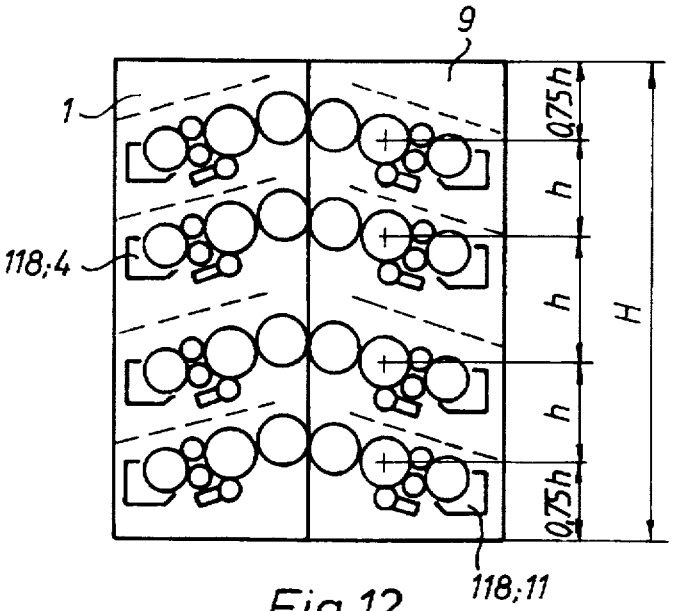
Fig. 12
Fig. 11
PRIOR ART

PRINTING GROUP FOR A COLOR-PRINTING WEB-FED ROTARY PRESS

FIELD OF THE INVENTION

The present invention relates to a printing system for a multi-color web-fed rotary printing press for sheet work.

DESCRIPTION OF THE PRIOR ART

Printing units in an H-shape, disposed in a tower arrangement one on top of the other, for example as a so-called tower of eight, are known from a company brochure of MAN-Roland Druckmaschinen AG (DE) (RA GEO 08.93.1). In this case, a printing unit in an H-shape consists of two printing units, each in a U-shape, and which are disposed mirror-reversed in respect to each other, which are also called U-printing units and which each have four cylinders in a bridge construction.

It is disadvantageous in connection with these printing units disposed on top of each other in tower construction that the paper web to be printed must travel over a comparatively long distance between the printing points, for example between the two printing units in an H-shape placed on top of each other to form a tower of eight, which can lead to registration difficulties. Moreover, the prior art said printing units arranged on top of each other have a great structural height, so that the operators must work on at least two levels of different height. Finally, it is furthermore disadvantageous that the inking systems associated with the printing units at one time have a direction of the ink flow from the top to the bottom and at another time a direction of the ink flow from the bottom to the top in accordance with the mirror-reversed arrangement of the individual U-shaped printing units, which can lead to different inking conditions.

SUMMARY OF THE INVENTION

It is the object of the invention to create a printing system for a multi-color web-fed rotary printing press for sheet work having a lower structural height, but with the same output parameters as the prior art devices.

This object is attained in accordance with the invention by using a printing system for multi-color sheet work for a web-fed rotary printing press in which two printing units are arranged in the so-called bridge construction as bridge units. These units have two inking systems, two printing cylinders and two rubber blanket cylinders which are oriented toward each other. Several of these bridge units are disposed above each other. The bridge units disposed above each other can be separated into left and right frame elements that can be placed at a horizontal distance from each other.

The following advantages in particular are achieved by means of the present invention:

The printing press in accordance with the present invention has a lower structural height and therefore lesser weight which, among other things, reduces the cost for the press foundation. Because of the reduced structural height of the press, it can be operated on only one level. The ink flow in each printing unit always has the same direction, so that the same inking conditions prevail in all printing units. Because of the reduced structural height, the amount of waste during start-up and during braking operations, for example during printing plate changes, is reduced. Furthermore, because of the reduced structural height, the expense for a possible enclosure of the press are reduced. Such an enclosure can be of importance for reasons of noise protection or for recovery of heat in connection with air cleaning. Furthermore, the oscillations being created in a printing press are reduced by means of the reduction of the structural height. Moreover, when a wet offset printing process is employed, the action of the so-called fan-out effect is weakened because of the reduced structural height of the printing press. Registration difficulties that are encountered with conventional printing processes, are decreased. Finally, the printing units of the printing press in accordance with the invention can also be employed as additional printing units for a flying printing plate change (imprinter).

It is thus possible to avoid the purchase of expensive installations for a so-called computer-to-press method.

BRIEF DESCRIPTION OF THE DRAWINGS

The invention will be described in greater detail below by means of several preferred embodiments. Shown in the associated drawings are in FIG. 1, a schematic lateral view of a printing system in: accordance with the present invention in the operating position, FIG. 2, a schematic lateral view in accordance with FIG. 1, but in the rest position, FIG. 3, a partial section, taken along line III—III in accordance with FIG. 1, but without representation of the dampening agent distribution roller, FIG. 4, in a further preferred embodiment, a partial top view of the topmost bridge printing unit in accordance with FIG. 1, with frame elements left out and without a printing plate changing device and without dampening and inking systems, turned by 90° clockwise, FIG. 5, a representation in accordance with FIG. 4 in another drive position, FIG. 6, a representation in accordance with FIG. 4, but with another drive, FIG. 7, a representation in accordance with FIG. 4, but with an individual drive, FIG. 8, an enlarged representation of a printing unit with an anilox inking system, FIG. 9, a detail X from FIG. 8, FIG. 10, a schematic representation of the arrangement of a bridge printing unit, FIG. 11, a lateral view of a so-called tower of eight in accordance with the prior art with printing units in an H-shape placed on top of each other, FIG. 12, a schematic lateral view of the printing units in accordance with FIG. 1 in a representation of reduced size, FIG. 13, an enlarged representation of a printing unit with a conventional inking system.

DETAILED DESCRIPTION OF THE PREFERRED EMBODIMENTS

Figure 8:
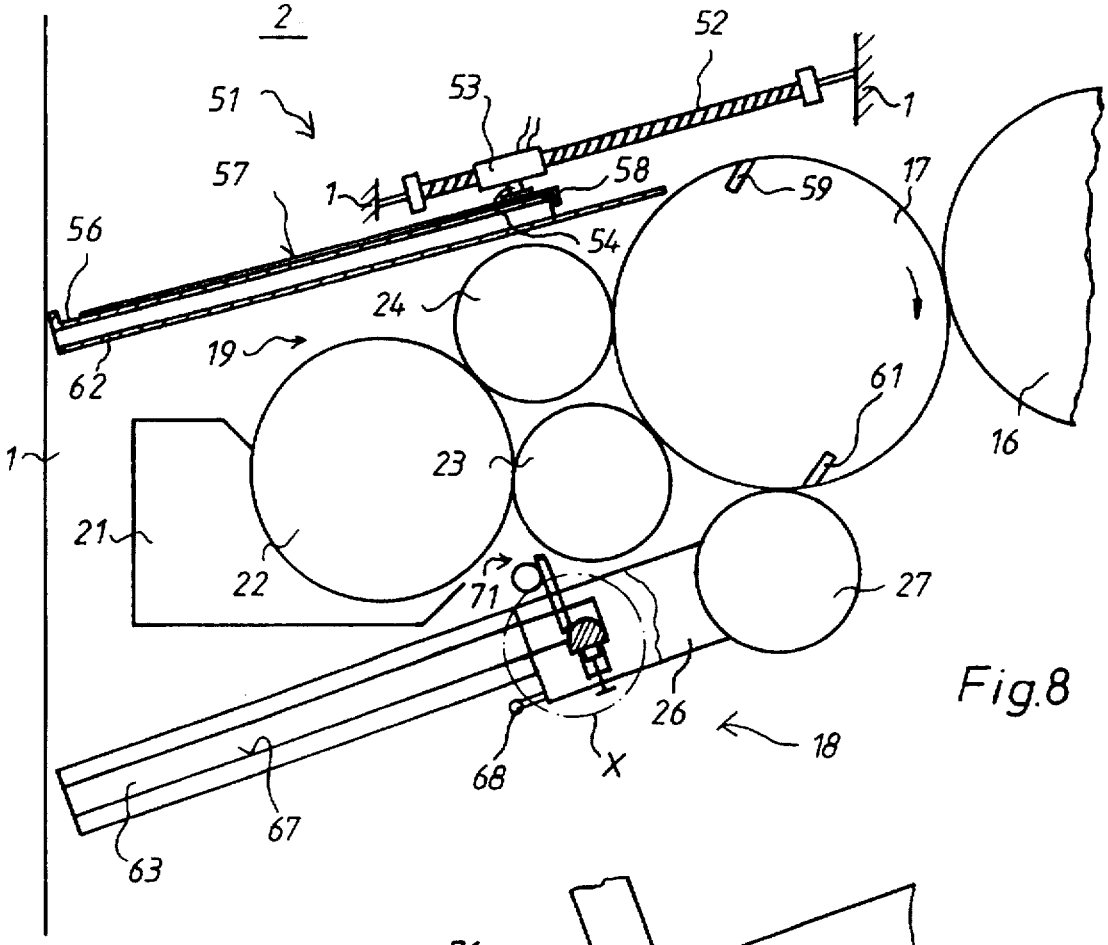
Figure 13:
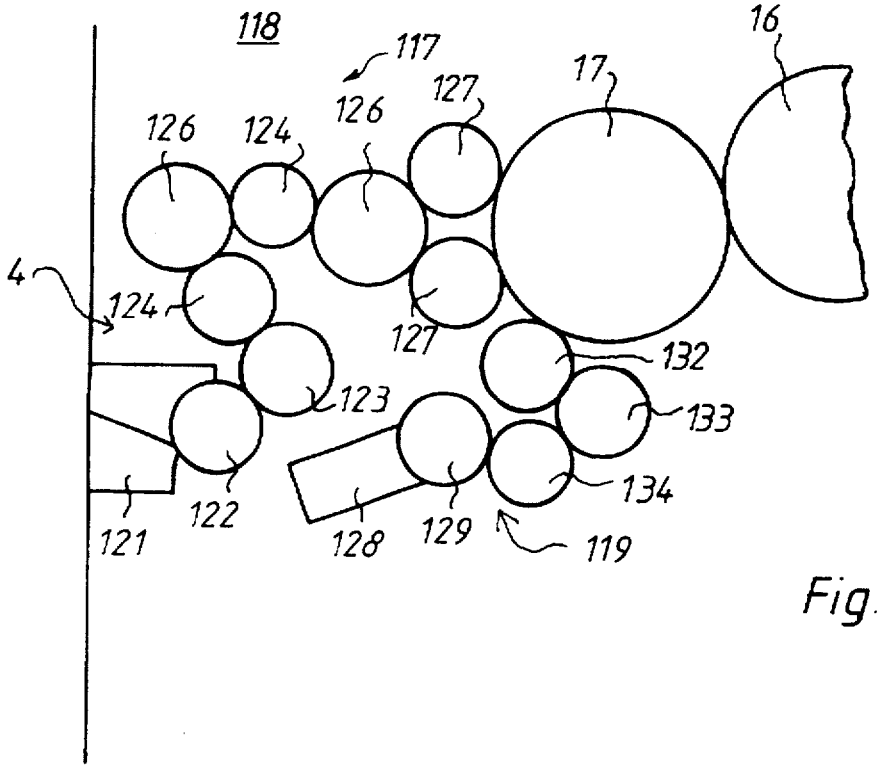

Upper supports 87, 88 as well as lower, horizontally extending lower supports 104, 105 of a multi-color web-fed rotary printing press receive several printing units arranged on top of each other and fixed in place on the supports in a left frame element 1, 6. As a whole, the printing system units are respectively identified by 2, 3, 4 and 5 as left printing units. Furthermore, a right frame element 9, 10, which is displaceable on rollers 7, 8 and which receives right printing units 11, 12, 13 and 14, is disposed between the supports 87, 88; 104, 105. Each printing system 2 to 5 and 11 to 14, respectively consists of a rubber blanket cylinder 16, which cooperates with a printing cylinder 17. The printing cylinder 17 receives dampening agents from a dampening system, identified as a whole by 18, and ink from an inking system, identified as a whole by 19. For example, the inking system 19 can consist of an inking trough 21 with an inking roller 22 as seen in FIG. 8, wherein the inking roller 22 transfers its printing ink by means of ink application rollers 23, 24 to the printing cylinder 17. In place of two ink application rollers 23, 24, it is also possible to only employ one smaller or larger ink application roller. In place of an inking trough 21 and an inking roller 22, it is also possible to employ a chamber doctor blade, for example, in connection with a screen roller or anilox roller. However, a conventional inking system can also be employed, as depicted in FIG. 13. Each dampening system 18 can be embodied as a spray dampening system consisting of a known spraying device 26, for example a strip with spray nozzles which direct their sprays on a dampening agent application rollers 27. This dampening agent application roller 27 is connected with the printing cylinder 17 as may be seen in FIG. 8.

The printing units 2 to 5, arranged between the supports 87, 88; 104, 105 stationary above each other, as well as the printing units 11 to 14, arranged above each other between the supports 87, 88, 104, 105 in displaceable frame elements 9, 10, are respectively disposed with their rubber blanket cylinders 16 facing each other, so that a respective paper web 28 or 29 can be printed on both sides. The possible contact points between the rubber blanket cylinders 16 (minus the thickness of the paper web 28 or 29) are identified by 31, 32, 33, 34 as is shown in FIG. 1, so that the printing systems comprised of printing units 2 together with 11, 3 together with 12, 4 together with 13 and 5 together with 14 each form a respective bridge printing unit with each other, or a printing unit in bridge construction, which is arranged vertically divisible and horizontally displaceable at their printing point 31 to 34.

Figure 1:
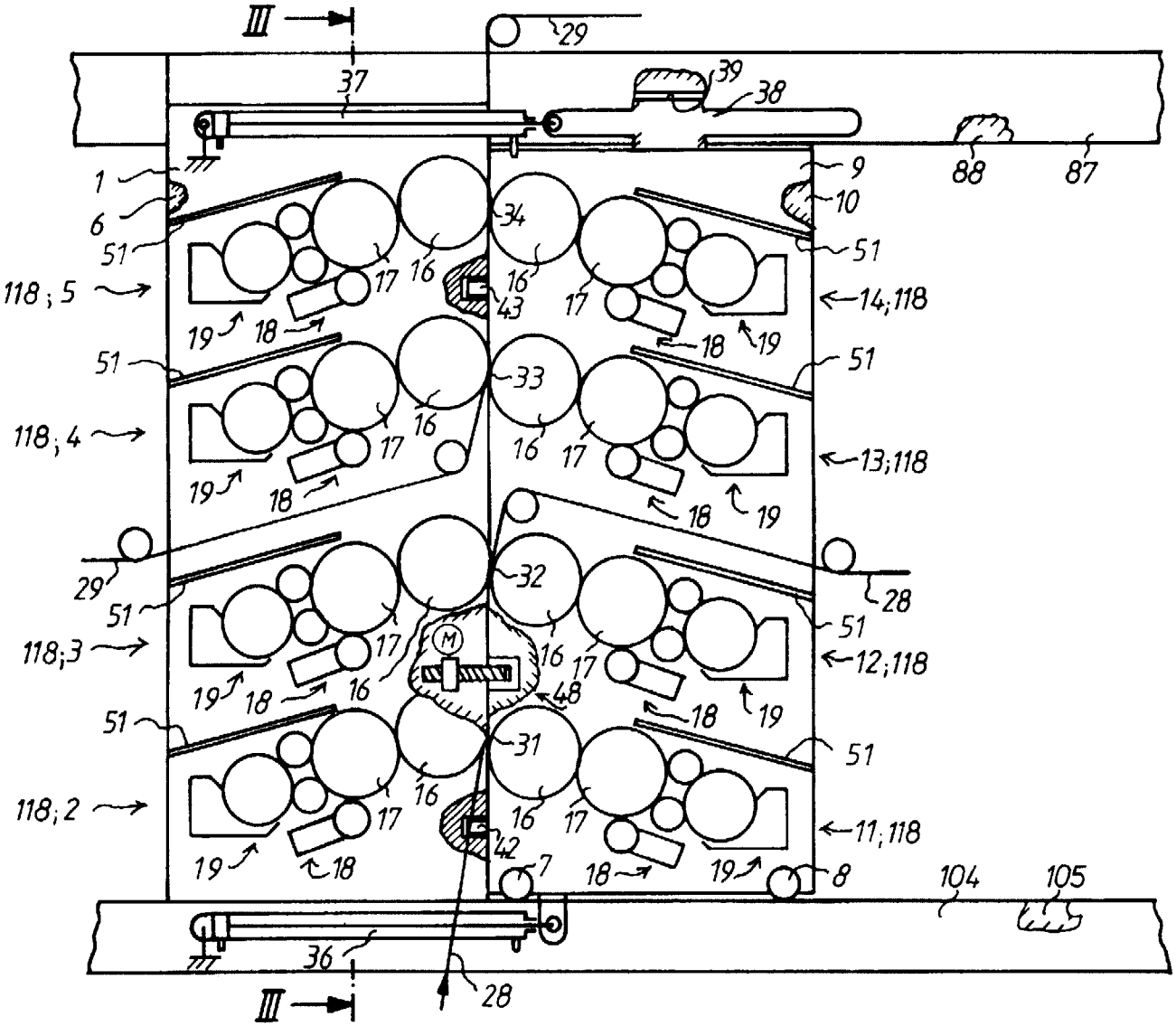
Figure 2:
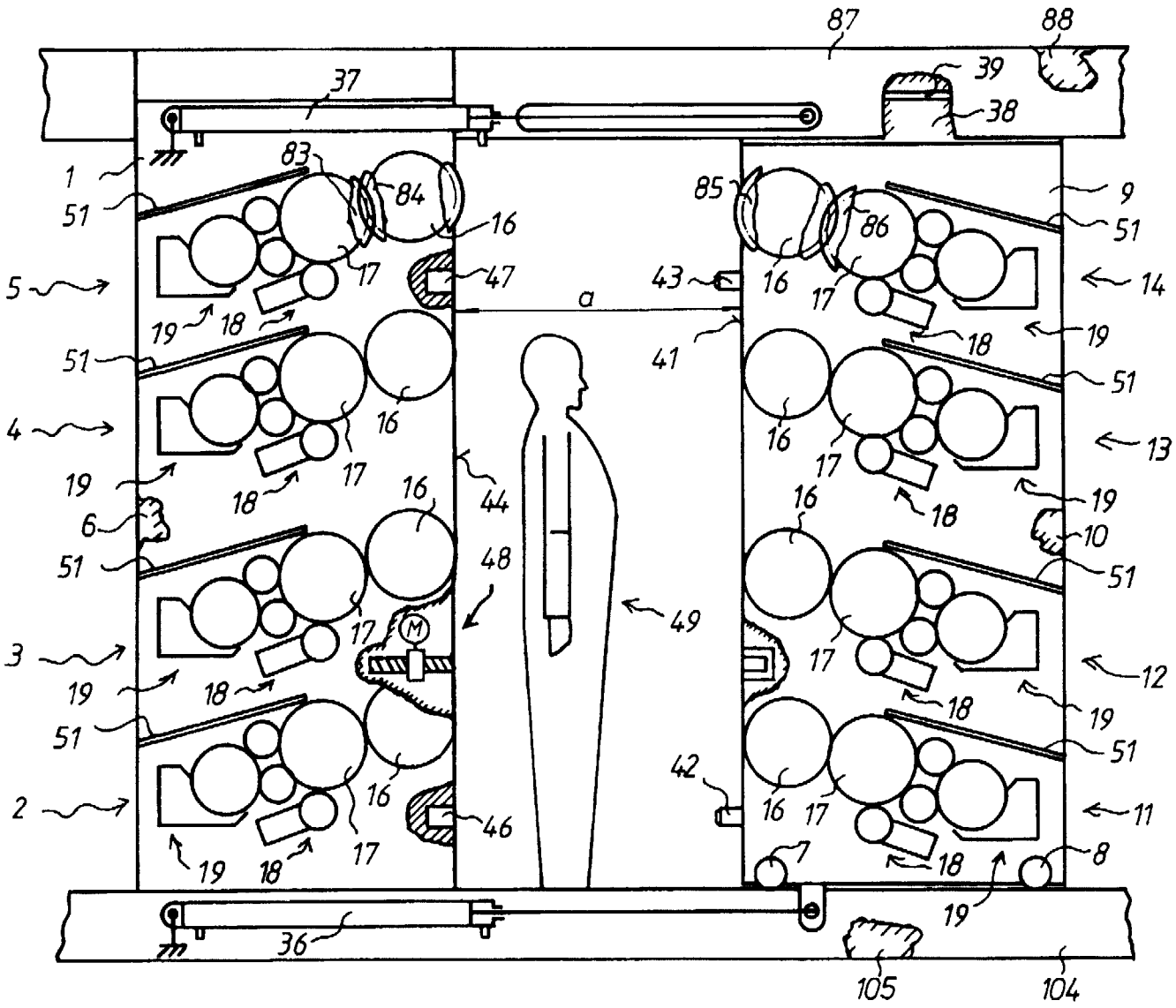

The displaceable frame 9, 10 can be actuated by means of two double-acting working cylinders 36 and 37, which are, for example, hydraulic cylinders, as seen in FIG. 1. In this case, each working cylinder 36, 37 is seated fixed in place in the side frame, and the end of the piston rod facing away from each cylinder is hingedly connected with the displaceable frame 9, 10 at its respective top or bottom sides. On its top, the frame 9, 10 respectively has a guide strip 38, which is guided in a groove 39 cut into the supports 87, 88 and is open at the bottom. For satisfactory smooth movement of the guide strip 38 in the groove 39, the flanks of the guide strip 38 can have recesses for receiving ball bearings, which support the guide strip 38 on the side walls of the groove 39 in the supports 87, 88. To achieve great exactness of fit when returning the displaceable frame 9, 10 from the rest position, which is shown in FIG. 2, into the operating position which is shown in FIG. 1, the frame 9, 10 has a plurality of pins 42, 43 on its perpendicular closure edge 41, which project past the closure edge 41, and which are receivable in blind bores 46, 47 in a perpendicularly extending closure edge 44 of the side frame 1. In the operating position shown in FIG. 1, the displaceable frame 9, 10 is protected against accidental displacement by means of a mechanically operating locking device, identified as a whole by 48. The locking device 48 consists of a threaded bush, seated fixed in place on the frame, and which forms an interlocking connection with a threaded spindle, seated fixed in place on the support, when the frame 9, 10 is closed. In the locking process, the threaded spindle is moved in the direction of the left frame element 1, 6 by means of a motor-driven threaded sleeve.

During a stoppage of the printing system, it is possible to manually change the printing plates on the printing cylinders 17 by separating the left printing units and the right printing units by a distance a between the left and right frames 1, 6, 9, 10 as seen in FIG. 2 to allow an operator 49 to move between the left and right units.

It is furthermore possible to change the printing plates on the printing cylinder 17 by means of a printing plate changing device, identified as a whole by 51 with one such plate changing device 51 being associated with each printing unit 2 to 5 and 11 to 14. This printing plate changing device 51 as may be seen in FIG. 8, consists of two linear guides 52 represented in, which are disposed fixed in place on the frame at a distance of at least one printing cylinder width, on which both ends of a gripper crosspiece 53 are guided. The gripper crosspiece 53 extends in an axis-parallel direction, with respect to the printing cylinder 17, and supports a number of suction devices 54, by means of which a printing plate 57, which is in a standby position on both sides of support rails 56 fixed in place on the frame, only one of which is represented in FIG. 8, can be picked up and suspended with its front bevel 58 in a suspension slit 59 of the printing cylinder 17 by means of the movement of the gripper crosspiece 53 on the linear guides 52. The printing plate 57 can either be clamped on both sides in suspension slits 59, 61 which are known from DE P 42 44 077.7, for example, or on only one side, as represented in FIG. 8, wherein the printing plate 57 is then held by means of magnets, not shown, inserted into the surface of the printing cylinder 17. The linear guides 52 can be embodied as threaded spindles, on which the gripper crosspiece 53 is moved by means of threaded sleeves turned by an electric motor.

The control of the rotating movement of the printing cylinder 17 and the synchronization of the insertion and removal of the printing plate is known from DE 39 40 796 C2. A sheet metal deposit plate 62, which is fixed in place in the side frames and that is as wide as the printing cylinder, extends parallel with and below the support rails 56, and is used for receiving the printing plates, not shown, taken off the printing cylinder. It is also possible to use support rails; fixed in place on the frame, in place of the sheet metal deposit plate 62. The printing plate changing device is only symbolically indicated in FIGS. 1 and 2.

Figure 9:
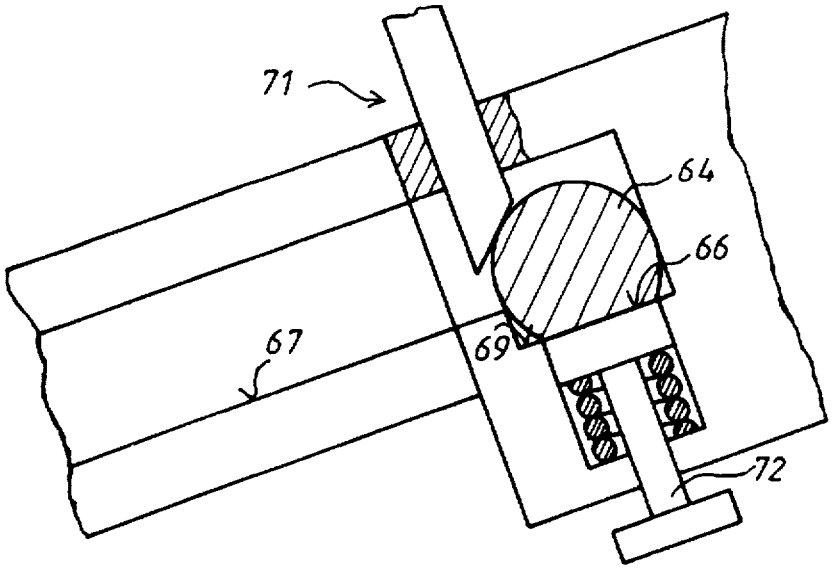

For the purpose of facilitating better maintenance of the dampening system 18, as well as the printing cylinder 17, there is the further possibility to embody the spraying device 26 of the dampening system 18 such that it can be pulled out of, or separated from the dampening system 18. A parallel guide 63, as seen in FIG. 8 is, respectively fastened on each frame 1, 6 or frame 9, 10, and is provided for this separation. Stud bolts 64 are placed on both sides interlockingly connected at the front on both sides of the housing of the spraying unit 26 and extending in an axis-parallel direction in respect to the printing cylinder 17, as seen in FIGS. 8 and 9. To be secure against relative rotation, the stud bolts 64 are respectively provided with a flattened surface 66 on one side of their circumference, and which slides on a contact surface 67 of the parallel guide 63, so that the spraying unit 26 can be pulled out by means of a handle 68. The spraying unit 26 can be locked in its operating position as is represented in FIG. 9, in that the flattening 66 of each stud bolt 64 engages a depression 69 located in the contact surface 67 and that each stud bolt 64 is maintained in this operating position by means of a clamping device 71 consisting of a toothed rack drive. In the process, the toothed rack, which can be moved by means of a pinion, presses against the stud bolt 64. Unlocking of the spraying unit 26 for the purpose of pulling it out, takes place in that the toothed rack of the clamping device 71 is moved back, so that by means of an ejector 72, acted upon by a spring force, the stud bolts 64 are lifted out of the depression 69 into the plane of the contact surface 67 of the parallel guide 63 so that they can be taken out. It will be understood that this assembly is not shown in FIGS. 1 and 2.

It is obvious that, for example, a second left frame element 6 as well as a second right displaceable frame element 10 are required for the functioning of the printing system, the same as second working cylinders for displacing the frames 6, 10, as well as associated locking devices and so forth.

Figure 3:
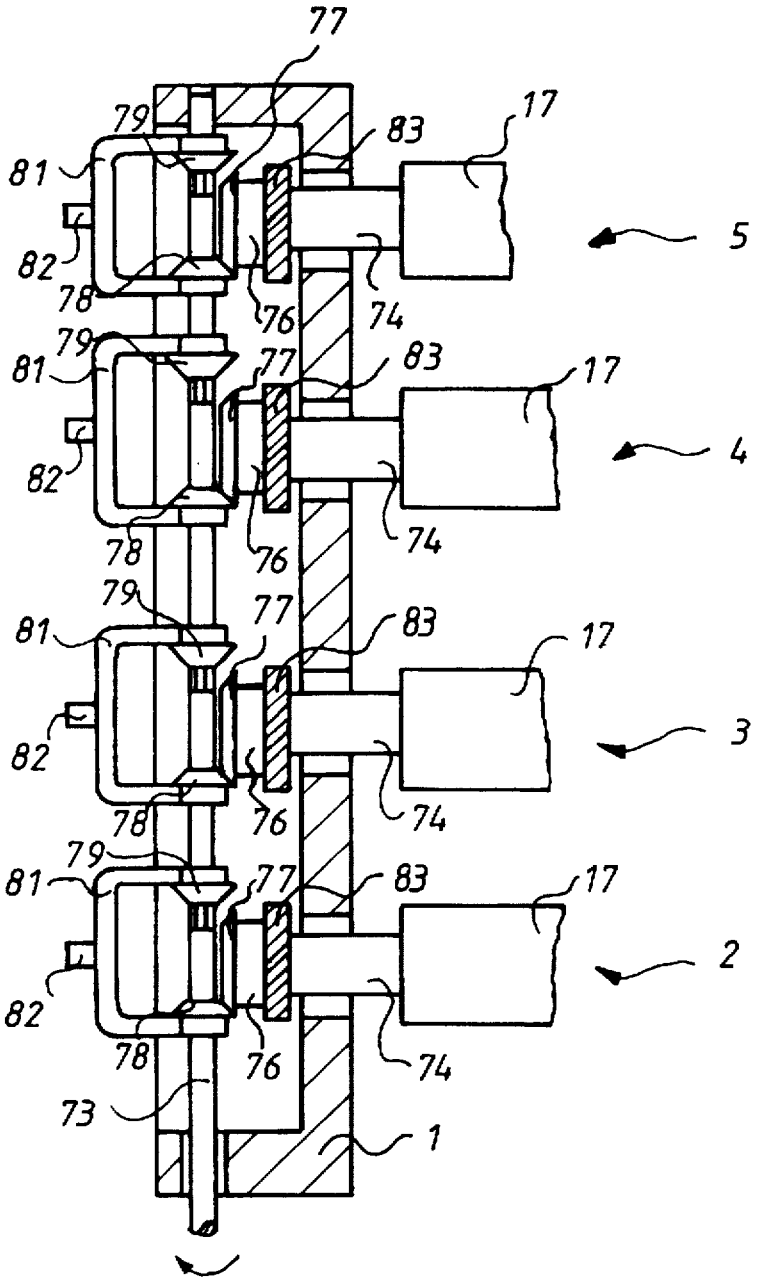

The propulsion of the individual bridge printing units 2, 11; 3, 12; 4, 13; 5, 14 takes place by means of a vertical shaft 73, which is shown in FIG. 3, and which is extending perpendicularly away from the main drive shaft of the printing press, and which drives the printing cylinders 17 of the stationary printing units 2, 3, 4, 5 arranged in a vertical plane above each other. Each printing units 2, 3, 4, 5 can be disengaged from the vertical shaft 73 via a journal 74 of the printing cylinder 17 seated in the frame 1, 6 by means of a, for example, electro-magnetic coupling 76. At least in the area of the periphery of a ring gear 77 connected with each coupling 76, the vertical shaft 73 is embodied as a multi-splined shaft, so that respectively one of two pinions 78 or 79, interlockingly disposed on the vertical shaft 73 and associated with the same ring gear 77 of each one of the printing units 2, 3, 4, 5, is in engagement with the ring gear 77. In FIG. 3 the ring gear 77, together with the respective pinion 78, constitutes a pair of conical wheels which are engaged with each other. In case of a desired reversal of the direction of rotation of the printing cylinder 17, both pinions 78, 79 disposed on the vertical shaft 73 are displaced in the vertical direction by means of a bow-shaped spreader 81, so that alternatively the pinion 79 can be moved into engagement with the ring gear 77. Actuation of the respective spreader 81 can take place manually by means of a handle 82 or by means of known electrical, hydraulic or pneumatic setting members. A spur wheel 83 is respectively also wedged on the journal 74 of each printing cylinder, and is also in engagement with spur wheels 84, 85, 86 which are interlockingly connected with the journals (not shown) of the rubber blanket cylinder 16 as well as of the second printing cylinder 17 shown only in connection with the printing system 5 and 14 in FIG. 2 but utilized in each bridge printing unit 2, 11; 3, 12; 4, 13 or 5, 14. In this case, the engagement of the spur wheels 84, 85 with each other only takes place when the printing press is in the operating position.

It is also possible to arrange the vertical shaft 73 in the perpendicular plane of the rubber blanket cylinders 16, disposed above each other, of the stationary printing systems 2, 3, 4 and 5.

The propulsion of the respective dampening system 18 and of the respective inking system 19 for each printing unit can take place either by friction with the printing cylinder 17 or by means of an individual motor drive of the inking roller 22 and of the dampening agent application roller 27, or by means of known gear wheel drives.

Figure 4:
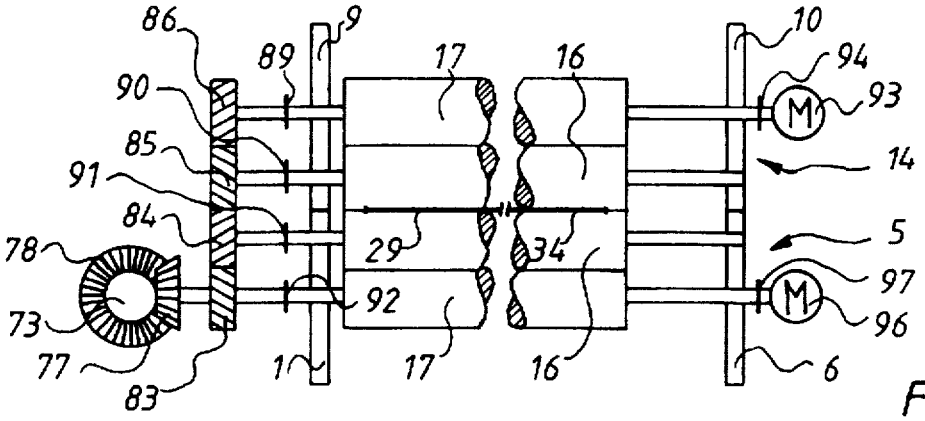
Figure 5:
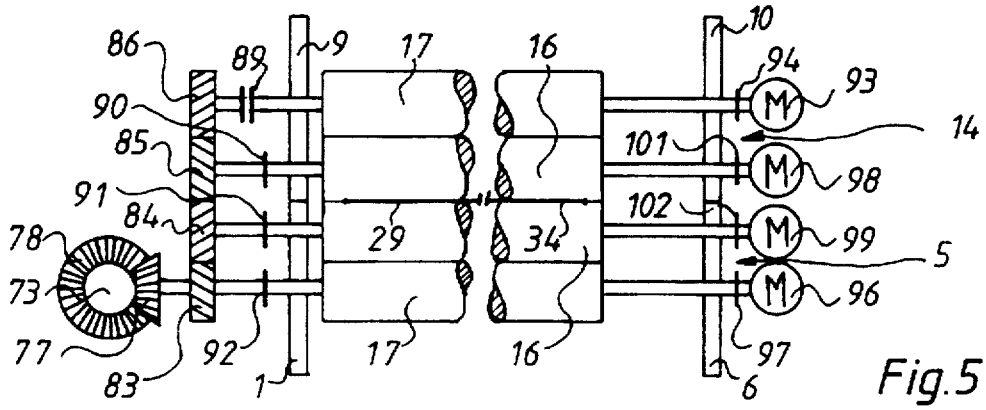

In accordance with another preferred embodiment of a drive for a bridge printing unit consisting of the printing units 5 and 14 as seen in FIG. 4, a difference with the previously discussed drive that is shown in FIG. 3 lies in that respectively one coupling 89, 92 has already been disposed between the printing cylinders 17 and the spur wheels 86, 83, and a coupling 90, 91 already between the rubber blanket cylinders 16 and the spur wheels 85, 84. Because of this it has become possible to take each of the cylinders 16, 17 out, of service individually, while with the drive in accordance with FIG. 3 this was only possible for both together. Each bridge printing unit 2, 11; 3, 12; 4, 13 or 5, 14 can be equipped with this drive, so that for example the printing cylinder 17 of each bridge printing unit 5, 14 can be switched off. In FIG. 5 the printing cylinder 17 of the printing system 14 has been uncoupled. The respectively uncoupled printing cylinder 17 can be provided with fresh printing plates while the printing press is operating (imprinter). In this case, the rubber blanket cylinder 16 assumes the function of a counter-pressure cylinder. In order to bring the printing cylinder 17 which has now been provided with fresh printing plates, up to the rpm of the other cylinders, the journal of the printing cylinder 17 is provided with an auxiliary drive motor 93 on the side of the second displaceable frame 10, which can be separated from the printing cylinder 17 by means of a coupling 94 after the required rpm have been reached, wherein the printing cylinder 17 of the printing system 14 can again be connected via the coupling 89 with the spur wheel 86, as seen in FIG. 5. It is alternatively possible, in the same way, to uncouple the printing cylinder 17 of the printing system 5 by means of a coupling 92 for the purpose of exchanging printing plates. In this case, an auxiliary drive motor 96 on the left frame 6 for restarting this printing cylinder 17is provided, which can be detached from the printing cylinder 17 via a coupling 97. It is, of course, furthermore also possible to take the entire bridge printing unit 5, 14 out of action by releasing the couplings 89 to 92, for example for performing cleaning and maintenance work. In this connection, it is advantageous to also provide the rubber blanket cylinders 16 of the printing systems 14, 5 on the second side of the frame 9 or 1 with auxiliary drive motors 98, 99, in order to make the turning of the rubber blanket cylinders 16 possible when the spur wheels 85, 84 are uncoupled, for example for changing the rubber blanket. In this case, too, the auxiliary drive motors 98, 99 can be uncoupled from the rubber blanket cylinders 16 by means of couplings 101, 102.

Figure 6:
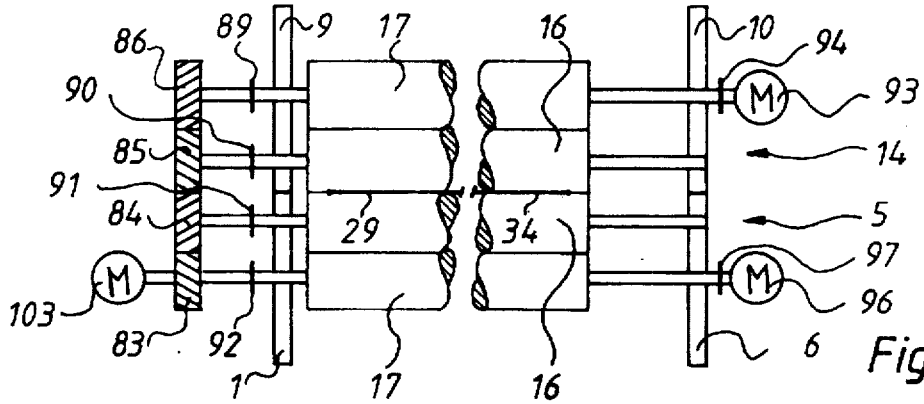

It is furthermore possible to provide a separate drive motor 103 for each bridge printing unit 2, 11; 3, 12; 4, 13 or 5, 14 in place of the vertical shaft 73, as may be seen in FIG. 6.

Figure 7:
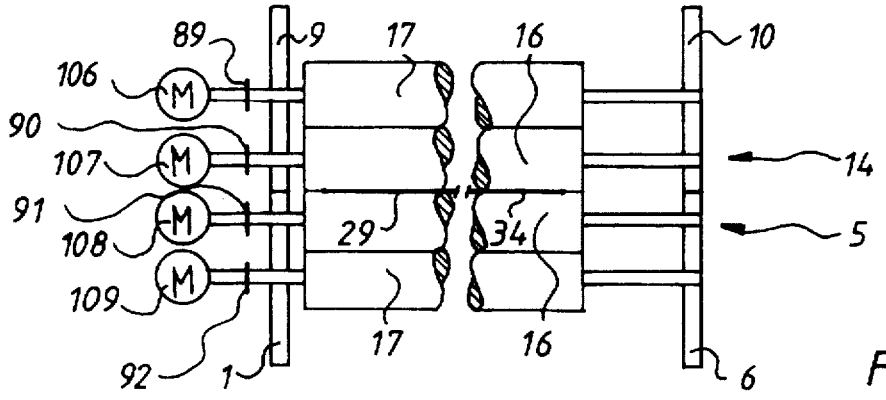

Finally, the rubber blanket cylinders 16 and printing cylinders 17 of each bridge printing unit 2, 11; 3, 12; 4, 13 or 5, 14 can respectively be provided with separate drive motors 106, 107, 108, 109, which can be uncoupled, all as seen in FIG. 7.

Referring now to FIG. 10, it will be seen that an imagined straight line passes through each of the rotary shafts 111, 112 of the rubber blanket and printing cylinders 16, 17 of each printing unit 2 to 5 and 11 to 14. Each such line which respectively represents a plane 114 or 110 and which is respectively arranged at an angle alpha in the range between zero to ±45° in respect to a horizontal line 113. Respectively, one rotary shaft 116 of the inking roller 22 can also be included in this plane 114.

A structural height H of the printing system with four bridge units 2, 11; 3, 12; 4, 13 or 5, 14, as depicted in FIG. 12, can be between nine and seventeen times the diameter of a printing cylinder 17 (H=4.5×h), wherein h equals the structural height of a printing unit or the spacing between the axes of rotation of printing cylinders 17 in adjacent printing units), wherein the diameter relates to the so-called "Berlin format". The spacing or structural height h of a printing unit 2, 3, 4, 5, 11, 12, 13 or 14 relates to twice to 3.75 times the diameter of a printing cylinder 17 in the "Berlin format".

The diameter of a printing cylinder 17 in the "Berlin format" is approximately 300 millimeters.

A known prior art printing press, which is a so-called tower of eight in an H-shape, available from man-Roland is represented in FIG. 11, and consists of eight printing systems, wherein always respectively two printing systems are combined into a U-shaped printing unit and are placed mirror-reversed on each other into an H-printing unit. The prior art tower of eight is formed in the style of H-printing unit on H-printing unit.

In a further preferred embodiment, as may be seen in FIG. 13, a printing unit 118 with a conventional inking system 117 and a modified dampening system 119 is represented, which printing unit 18 can be employed in place of the printing units 2 to 5 and 11 to 14 with the dampening systems 18 and the short inking systems 19. In this case, the conventional inking system 117 can consist of an inking trough 121 with an inking ductor 122 and a coating roller 123, which are followed by two ink transfer rollers 124, between which ink distributing rollers 126 are placed. The latter of the two ink distributing rollers 126 is connected via two ink application rollers 127, which are arranged parallel with each other, with the printing cylinder 17. The modified dampening system 119 can consist of a spray dampening system 128 with a moisture distribution cylinder 129, wherein the moisture distribution cylinder 129 is connected via two dampening agent transfer rollers 133, 134 with a dampening agent application roller 132 resting against the printing cylinder 17.

The printing system in accordance with the invention can be particularly employed in connection with the following printing processes: for conventional offset printing and for anilox offset printing, for indirect letterpress printing and also for waterless offset printing.

We claim:

1. A printing system for the multi-color printing of one or more webs in a web-fed rotary printing press comprising:

a plurality of left printing units, each of said left printing units having a left inking system, a left printing cylinder and a left rubber blanket cylinders;

a plurality of right printing units, each of said right printing units having a right inking system, a right printing cylinder and a right rubber blanket cylinder;

a plurality of bridge printing units formed by cooperating ones of said left and right printing units, each of said bridge printing units having one of said left printing units and one of said right printing units, said left and right blanket cylinders in each of said bridge printing units being engageable with each other to print a web passing vertically therebetween, said plurality of bridge printing units being disposed one above the other;

a left frame element for receiving said plurality of left printing units;

a right frame element for receiving said plurality of right printing units; and means for supporting at least one of said left and right frame elements for horizontal movement with respect to the other of said left and right frame elements so that said left and right frame elements can be separated by a horizontal distance from each other to separate said left and right blanket cylinders in said plurality of bridge printing units from each other.

2. The printing system of claim 1 further including a support for said frame elements and wherein one of said frame elements is fixed in place on said support.

3. The printing system of claim 1 further including means to lock said left and right frame elements together in an operating position.

4. The printing system of claim 1 wherein each of said inking systems is an anilox short inking system.

5. The printing system in accordance with claim 4 wherein each said anilox short inking system includes at least one anilox roller with a chamber doctor blade associated with it and at least one ink application roller associated with said anilox roller, and an inking trough arranged under said anilox roller.

6. The printing system of claim 1 further including a dampening system associated with each said printing unit.

7. The printing system of claim 6 wherein each said dampening system consists of a dampening agent application roller and a dampening fluid spraying device.

8. The printing system of claim 1 further including a printing plate changing device associated with each of said printing cylinders of each of said printing units.

9. The printing system of claim 8 wherein each said printing plate changing device includes first and second linear guides, a displaceable plate gripper crosspiece secured between said linear guides and movable thereon in a direction toward and away from an associated one of said printing cylinders, and suction devices on said plate gripper crosspiece.

10. The printing system of claim 6 further including means to switch off each of said printing cylinders and its associated inking system and dampening system.

11. The printing system of claim 10 wherein said dampening unit has a spraying device and a dampening agent application roller, said spraying device being separable from said application roller by use of first and second parallel guides.

12. The printing system of claim 1 wherein each said printing unit has a structural height which is between two and four times a diameter of said printing cylinder in its associated printing unit.

13. The printing system of claim 1 wherein each said inking system of each said printing unit is a conventional inking system.

14. The printing system of claim 1 further including a drive assembly for each said printing unit and a coupling disposed between each said cylinder in each said printing unit and said drive assembly for each said printing unit.

15. The printing system of claim 14 wherein said drive assembly includes a vertical shaft.

16. The printing system of claim 14 wherein said drive assembly includes a main motor.

17. The printing system of claim 14 wherein said drive assembly is an individual drive motor for each cylinder in each of said printing units.

18. The printing system of claim 14 further including an auxiliary drive motor adapted to be coupled into said drive assembly.

19. The printing system of claim 1 wherein each of said rubber blanket cylinders and each of said printing cylinders is supported by a separate rotary shaft and wherein said rubber blanket rotary shaft and said printing cylinder rotary shaft for each of said printing units are disposed in a plane which extends at an angle with respect to a horizontal line.

20. The printing system of claim 19 wherein said angle lies in a range between 0° to 45°.

21. The printing system of claim 1 wherein one of said left and right frame elements is supported on rollers and is displaceable horizontally with the other of said left and right frame elements.

* * * * *